US008635724B2

(12) United States Patent
Moorhouse

(10) Patent No.: US 8,635,724 B2
(45) Date of Patent: Jan. 28, 2014

(54) SHEET CONNECTING APPARATUS

(76) Inventor: Genevieve A. Moorhouse, Alexandria, VA (US)

( * ) Notice: Subject to any disclaimer, the term of this patent is extended or adjusted under 35 U.S.C. 154(b) by 0 days.

(21) Appl. No.: 13/226,305

(22) Filed: Sep. 6, 2011

(65) Prior Publication Data

US 2012/0110737 A1 May 10, 2012

Related U.S. Application Data

(63) Continuation of application No. 12/732,670, filed on Mar. 26, 2010, now abandoned, which is a continuation of application No. 12/169,887, filed on Jul. 9, 2008, now abandoned.

(60) Provisional application No. 60/958,754, filed on Jul. 9, 2007.

(51) Int. Cl.
*A47G 9/02* (2006.01)
*A47G 9/04* (2006.01)

(52) U.S. Cl.
USPC ..... 5/496; 5/482; 5/495

(58) Field of Classification Search
None
See application file for complete search history.

(56) References Cited

U.S. PATENT DOCUMENTS

| | | | | | |
|---|---|---|---|---|---|
| 1,742,064 | A | * | 12/1929 | Dinstuhl | 5/498 |
| 2,630,587 | A | * | 3/1953 | Brown | 5/496 |
| 2,789,292 | A | | 4/1957 | Budinquest | |
| 3,179,956 | A | | 4/1965 | Bennett | |
| 3,179,958 | A | | 4/1965 | Rita | |
| 3,832,743 | A | | 9/1974 | Smith | |
| 4,040,133 | A | | 8/1977 | Gilreath | |
| 4,413,368 | A | | 11/1983 | Schuetze | |
| 4,658,454 | A | * | 4/1987 | Potter | 5/497 |
| 4,903,361 | A | * | 2/1990 | Tang | 5/502 |
| 5,042,099 | A | | 8/1991 | Brenner et al. | |
| 5,099,531 | A | * | 3/1992 | Schmier | 5/498 |
| 5,321,862 | A | * | 6/1994 | Campbell | 5/482 |
| 5,367,729 | A | * | 11/1994 | Lazar et al. | 5/494 |
| 5,557,814 | A | * | 9/1996 | Cybulski | 5/496 |
| 5,572,754 | A | * | 11/1996 | Lazar et al. | 5/494 |
| 6,098,219 | A | | 8/2000 | Milbur | |
| 6,886,197 | B1 | | 5/2005 | Madigan | |
| 6,966,090 | B2 | * | 11/2005 | McClintock et al. | 5/706 |
| 6,971,128 | B1 | * | 12/2005 | McGrath | 5/490 |
| 7,086,102 | B1 | | 8/2006 | Frazier | |
| 2002/0144346 | A1 | * | 10/2002 | McTyre | 5/482 |
| 2005/0198724 | A1 | * | 9/2005 | Steitle et al. | 2/244 |
| 2007/0214569 | A1 | * | 9/2007 | Miller | 5/482 |
| 2007/0271699 | A1 | * | 11/2007 | Sacchetti | 5/495 |

* cited by examiner

*Primary Examiner* — Gilbert Lee

(74) *Attorney, Agent, or Firm* — Erickson Law Group, PC

(57) ABSTRACT

A sheet connecting apparatus having a top and a bottom sheet. The bottom sheet has one or more buttons near at least one end of the bottom sheet. The top sheet has one or more button holes near at least one end of the top sheet. The buttons and the button holes are each positioned on the respective bottom sheet and top sheet for aligning the top sheet on the bottom sheet and for connecting the top sheet to the bottom sheet.

18 Claims, 2 Drawing Sheets

Figure 3
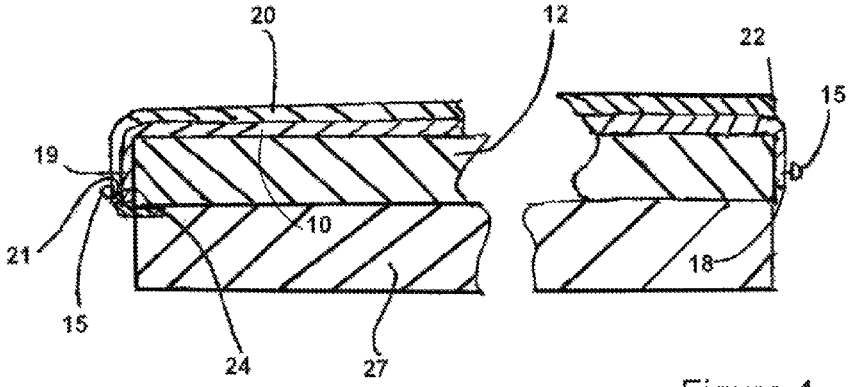
Figure 4
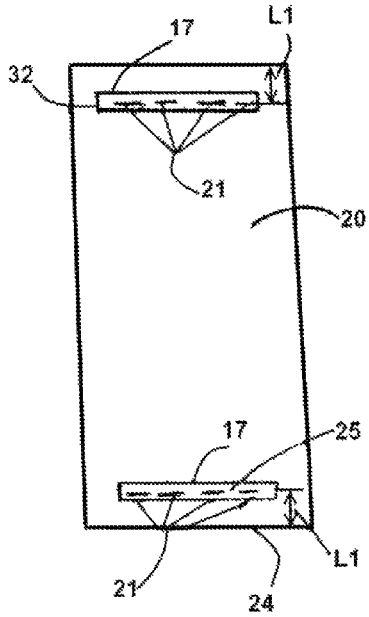
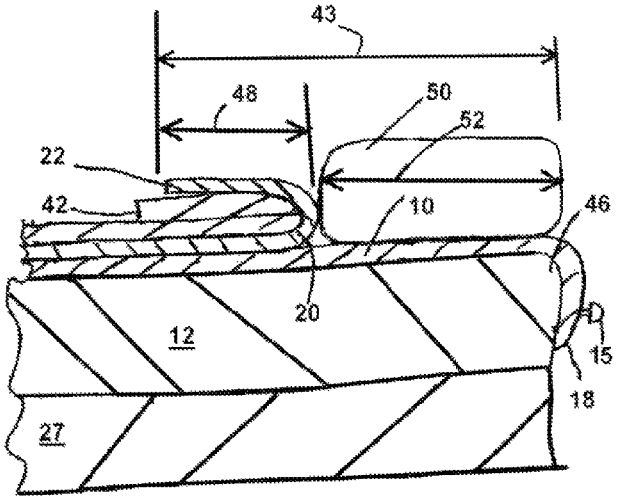
Figure 5

SHEET CONNECTING APPARATUS

This application is a continuation of U.S. application Ser. No. 12/732,670 filed on Mar. 26, 2010 now abandoned which is a continuation of U.S. non provisional patent application Ser. No. 12/169,887 filed on Jul. 9, 2008 now abandoned and which claims the benefit of U.S. provisional patent application Ser. No. 60/958,754 filed on Jul. 9, 2007.

TECHNICAL FIELD OF THE INVENTION

The invention is directed to a method of making a bed. Particularly, the invention is directed to sheet sets for making a bed.

BACKGROUND OF THE INVENTION

There are known systems to organize bed sheets by attaching lied sheets to the bed or to each other. U.S. Pat. Nos. 4,040,133; 5,042,099; and 3,832,743 disclose VELCRO attachments of bottom bed sheets to top bed sheets. The top and bottom sheets must be aligned correctly to register the VELCRO attachments.

U.S. Pat. No. 5,099,531 discloses a method of making a bed wherein the bottom sheet and the top sheet are attached to the bed mattress by buttons along the bottom end of the bed. The mattress must have pre-installed buttons for the sheets to be connected to the mattress. The sheet attaching method is not usable on a pre-existing mattress without modification.

U.S. Pat. No. 7,086,102 discloses a method of making a bed where the bottom sheet is attached to the mattress via elastic bands. A top fabric covering is permanently attached by stitching to the bottom sheet at the foot region of the bottom sheet. The top fabric covering the bottom sheet must be laundered together and if one becomes worn or torn both must be renewed or discarded.

For making up beds in an attractive manner such as for making up beds in an upscale hotel, or a formal home, the top flat sheet must be placed in a definite lengthwise position on the bottom fitted sheet to ensure that the top flat sheet extends toward the head of the bed a pre-selected amount. The reason for this is to ensure a pre-selected fold-over length of the top sheet to be folded over the top blanket in a stylish, inviting and attractive manner. When making up such a bed, a person must estimate the length of top sheet tuck-under beneath the mattress at the foot end of the bed to set the desired position of the head end of the top sheet. If the estimate is wrong, the top sheet must be pulled out from beneath the mattress at the foot end of the bed and the bed must be remade, to ensure a neat and stylish look of the made bed at the head end. The present inventor has recognized that it would be desirable to provide a sheet set that made the positioning of the top flat sheet on the bottom fitted sheet easily done and preferably automatically accomplished without time-wasting trial and error when making a bed.

Furthermore, workers in hospitals and hotels spend many hours making beds. The present inventor has recognized that it would be desirable to utilize a more efficient and time saving method of making each bed. The present inventor has recognized that it would be desirable to provide a top and bottom sheet combination that is easily and quickly attachable along a foot end of the bottom sheet, that requires a minimum of planning or forethought making the bed, and which allows a top sheet to be attached to a bottom sheet and used to cover a standard mattress.

SUMMARY OF THE INVENTION

The present invention provides a system for making a bed that allows top and bottom sheets to be quickly coupled together to assist in making a bed.

The system allows the top sheet to be automatically positioned precisely on the bottom sheet to achieve a neat and stylish sheet-fold-over made bed the first time and every time. The present invention increases the time efficiency and accuracy in making up a stylish bed in a formal home or luxury hotel.

The top and bottom sheets can be pre-coupled at a single location such as in a laundry room and then brought to the bed location. The top and bottom sheets can be laundered together or separately and can be replaced as separate components. The top and bottom sheets can have some redundancy in connection arrangement regarding the relative position of the sheets, head end or foot end, so that planning and manipulation of the sheets to make the coupling is greatly reduced. This is helpful for workers who must make many beds within a limited time period.

According to the preferred embodiment, buttons are used to connect the bottom and top sheets. The buttons are sewn on the head end and foot end edge portions of the fitted lower sheet, and button holes are provided spaced from the foot end of the upper sheet a pre-selected distance. The buttons along the head and foot end edge portions of the bottom sheet are redundant so that either end of the bottom sheet can be placed on the foot end of the bed. Also, if buttons are missing from one end of the bottom sheet the bottom sheet can be turned around and the buttons from the opposite end can be used, prolonging the useful life of the bottom sheet.

Alternatively, to increase redundancy, button holes can be provided spaced from both the foot end edge portion and the head end edge portion of the top sheet as well. In some circumstances, either end of the top sheet could be fastened to the foot end of the bottom sheet.

The invention comprises a method of making a bed by connecting the top and bottom sheets together at a foot end of the bed. The connection of the bottom sheet to the top sheet prevents the undesired movement of the top sheet while sleeping. The present invention also increases the time efficiency in making beds in multi-bed residences.

According to one example of the preferred embodiment, tour buttons about 0.75" in circumference are sewn on a twin size sheet at each end of the bottom sheet. The buttons can be sewn onto twill tape that extends about 8" across in the middle of the width of the bottom sheet at both ends of the bottom sheet.

Button holes can be provided through the top sheet at regular widthwise-intervals that match the location of the buttons of the bottom sheet. The holes can be provided through twill tape that is attached to the top sheet at a predetermined distance from a foot end edge of the top sheet.

The present invention provides for versatile sheet management. The top sheet and the bottom sheet can be fastened together and used on any mattress, and if either the top sheet or the bottom sheet gets worn or torn, replacements can be purchased for only the worn or torn component.

Although buttons and button holes are preferred, snaps and the like are also encompassed by the invention.

Numerous other advantages and features of the present invention will be become readily apparent from the following detailed description of the invention and the embodiments thereof, and from the accompanying drawings.

BRIEF DESCRIPTION OF THE DRAWINGS

FIG. 3 is a cross sectional view of the bottom sheet of FIG. 1 attached to the top sheet of FIG. 2 and applied onto a mattress;

FIG. 4 is a plan view of an alternate top sheet of the invention;

FIG. 5 is a fragmentary sectional view of a made up bed.

DETAILED DESCRIPTION OF THE PREFERRED EMBODIMENT

While this invention is susceptible of embodiment in many different forms, there are shown the drawings, and will be described herein in detail, specific embodiments thereof with the understanding that the present disclosure is to be considered as an exemplification of the principles of the invention and is not intended to limit the invention to the specific embodiments illustrated.

Figure 1:
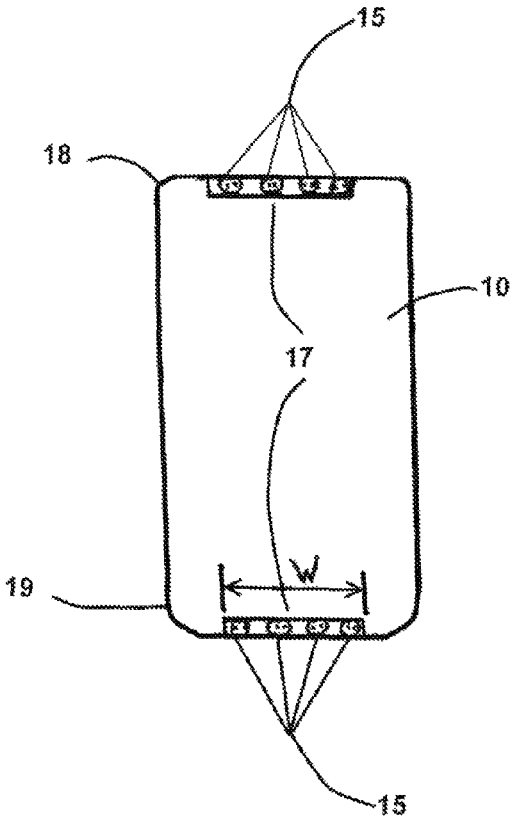
FIG. 1 is a plan view of a bottom sheet of the present invention.

FIG. 1 illustrates a plan view of bottom fitted sheet 10 to be fit to a mattress 12 (see FIG. 3) of a bed with buttons 15 sewn onto twill tape 17 at a first end 18 and a second end 19 of the bottom fitted sheet 10. Preferably, the width W of the button row is about 8" centered widthwise on the fitted sheet 10, between the corner elastic portions typically provided on conventional fitted sheets.

Figure 2:
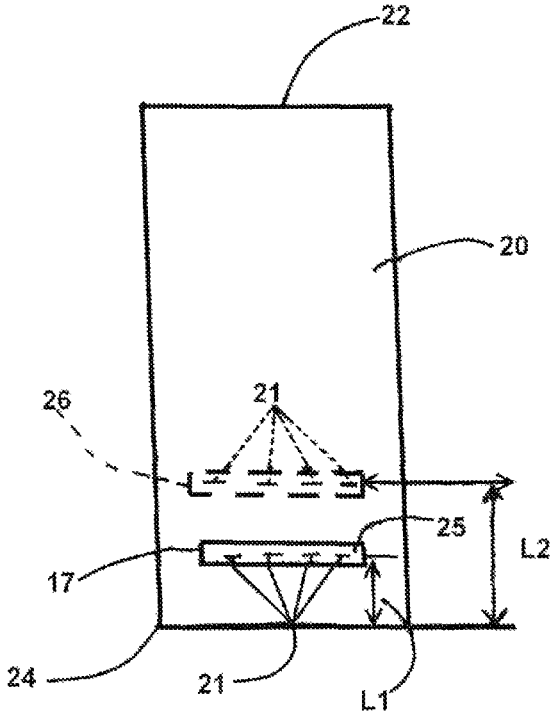
FIG. 2 is a plan view of a top sheet of the present invention.

FIG. 2 illustrates a plan view of a top flat sheet 20 with a row 25 of button holes 21 provided through twill tape 17 at regular widthwise intervals near a foot end 24 of the top flat sheet 20. The button holes 21 are spaced apart to match the spacing of the buttons 15 on the bottom fitted sheet 10. For a twin mattress, the distance from the foot end 24 of the sheet 20 and the row 25 of button holes L1 is preferably from 14 inches to 17 inches depending on the desired amount of fold over length of the flat sheet 20 at the head of the bed as explained in FIG. 5.

Optionally, an additional row 26 of button holes 21 can be provided, if desired, set at a second pre-selected distance L2 to the foot end 24 of top flat sheet 20 depending on the desired style of the made up bed or to compensate for a mattress of a different thickness to set the end 22 of the top flat sheet 20 at a desired lengthwise position (see. FIG. 5).

FIG. 3 illustrates a cross sectional view of the mattress 12 covered by a bottom fitted sheet 10 and a top flat sheet 20 and set on a box spring mattress 27. The bottom fitted sheet 10 and the top flat sheet 20 are connected by the buttons 15 at the second end 19 of the bottom sheet, and the button holes 21 near the foot end 24 of the top flat sheet 20. Buttons 15 are present on the first end 18 of the bottom fitted sheet 10 are for redundancy and are not used when at the head end of the bed.

FIG. 4 illustrates a plan view of an alternate top flat sheet 20 of the invention with button holes 21 in a row 25 near the foot end 24 of the sheet 20 and additional button holes 21 in a row 32 near the head end 22 of the flat sheet 20. Button hole rows 25 and 32 are preferably located the pre-selected distance L1 away from the adjacent ends 24, 22 of the top flat sheet 20.

The invention also encompasses having redundant button holes at both ends 22 and 24 of the top sheet and buttons 15 only at one end 18 or 19 of the bottom fitted sheet 10.

FIG. 5 illustrates a turned over made up bed having the top flat sheet 20 folded over a blanket 42 with the head end 22 of the top sheet ultimately located at a pre-determined, desired distance 43 away from the head end 46 of the mattress 12 with a desired fold over length 48. The ultimate lengthwise location of the end 22 is pre-set by the connection of the buttons 15 and the button holes 21 near the foot end of the bed and the desired fold over length 48. The position of the end 22 allows for the precise placement of a pillow 50 having a width 52 in the lengthwise bed direction on the fitted sheet 10 at the head end of the bed. The engagement of the buttons 15 with the button holes 21 ensures both a precise length positioning of the end 22 but also a consistent fold over dimension 48 across the width of the bed. An attractive, neat and orderly made up bed is achieved.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A bed sheet connecting apparatus comprising:

a fitted bottom bed sheet having corner elastic portions for gripping the bottom bed sheet to a bed or mattress or cushion, the fitted bottom bed sheet having a head end portion opposite a foot end portion, the head end portion and foot end portion arranged to overlie vertical end walls of a mattress;

a top bed sheet having a head end opposite a foot end, the top bed sheet having a rectangular perimeter;

the bottom bed sheet having a row of buttons sewn thereon on the foot end portion that overlie the vertical end wall of the mattress at a foot end thereof;

the top bed sheet having a row of button holes near the foot end thereof;

the row of buttons and the row of button holes each positioned on the respective bottom bed sheet and top bed sheet for aligning the top bed sheet on the bottom bed sheet, and for connecting the top bed sheet to the bottom bed sheet; and wherein the lengthwise location of the head end portion of the top bed sheet is pre-set by the connection of buttons of the row of buttons and button holes of the row of button holes, the location of the head end portion of the top bed sheet compatible with a desired fold over length of the top bed sheet at the head end portion, and wherein a folded edge of the top bed sheet, when the top sheet is folded over according to the desired fold over length is located at a distance from a head end of the mattress to allow a bed pillow to be placed between the folded edge of the top bed sheet and the head end of the mattress;

wherein the row of buttons is a first row of buttons, and the apparatus comprises a second row of buttons located near an end opposite the end having the first row of buttons.

2. The bed sheet connecting apparatus of claim 1, wherein a portion of the bottom bed sheet comprises a second layer of material for interspacing and strengthening the connection between the one or more buttons and the bottom bed sheet.

3. The bed sheet connecting apparatus of claim 2, wherein the second layer of material comprises twill tape.

4. The bed sheet connecting apparatus of claim 1, wherein a portion of the top bed sheet comprises a second layer of material for strengthening the one or more button holes.

5. The bed sheet connecting apparatus of claim 4, wherein the second layer of material comprises twill tape.

6. The bed sheet connecting apparatus of claim 1, wherein the button holes of the row of button holes are spaced apart to match the spacing of the buttons of the first row of buttons for aligning the top bed sheet on the bottom bed sheet, and for connecting the top bed sheet to the bottom bed sheet.

7. The bed sheet connecting apparatus of claim 6, wherein the width of the first row of buttons is about 8 inches and is centered widthwise along an end of the bottom bed sheet; and wherein the width of the row of button holes is about 8 inches and is centered widthwise along a corresponding end of the top bed sheet.

8. The bed sheet connecting apparatus of claim 1, wherein the first row of buttons is located between about 14 inches and about 17 inches from one end of the bottom bed sheet; and wherein the row of button holes is located between about 14 inches and about 17 inches from one end of the bottom bed sheet.

9. A bed sheet connecting apparatus comprising:

a fitted bottom bed sheet having corner elastic portions for gripping the bottom bed sheet to a bed or mattress or cushion, the fitted bottom bed sheet having a head end portion opposite a foot end portion, the head end portion and foot end portion arranged to overlie vertical end walls of a mattress;

a top bed sheet having a head end opposite a foot end, the top bed sheet having a rectangular perimeter;

the bottom bed sheet having a row of buttons sewn thereon on the foot end portion that overlie the vertical end wall of the mattress at a foot end thereof;

the top bed sheet having a row of button holes near the foot end thereof;

the row of buttons and the row of button holes each positioned on the respective bottom bed sheet and top bed sheet for aligning the top bed sheet on the bottom bed sheet, and for connecting the top bed sheet to the bottom bed sheet; and wherein the lengthwise location of the head end portion of the top bed sheet is pre-set by the connection of buttons of the row of buttons and button holes of the row of button holes, the location of the head end portion of the top bed sheet compatible with a desired fold over length of the top bed sheet at the head end portion, and wherein a folded edge of the top bed sheet, when the top sheet is folded over according to the desired fold over length is located at a distance from a head end of the mattress to allow a bed pillow to be placed between the folded edge of the top bed sheet and the head end of the mattress;

wherein the row of buttons is located a predefined distance from the foot end of the bottom bed sheet; and wherein the row of button holes is located the same predefined distance from the foot end of the top bed sheet;

wherein a second one or more button holes are located a predefined distance from the head end of the top bed sheet, the predefined distance equaling the predefined distance that the row of buttons are located from the foot end of the bottom bed sheet.

10. The bed sheet connecting apparatus of claim 9, wherein a second one or more buttons are located a predefined distance from the head end of the bottom bed sheet, the predefined distance equaling the predefined distance that the row of buttons are located from the foot end of the bottom bed sheet.

11. A bed sheet connecting apparatus comprising:

a fitted bottom bed sheet having corner elastic portions for gripping the bottom bed sheet to a bed or mattress or cushion, the fitted bottom bed sheet having a head end portion opposite a foot end portion, the head end portion and foot end portion arranged to overlie vertical end walls of a mattress;

a top bed sheet having a head end opposite a foot end, the top bed sheet having a rectangular perimeter;

the bottom bed sheet having a first row of buttons sewn thereon on the foot end portion that overlie the vertical end wall of the mattress at a foot end thereof;

the top bed sheet having a first row of button holes near the foot end thereof;

the first row of buttons and the first row of button holes each positioned on the respective bottom bed sheet and top bed sheet for aligning the top bed sheet on the bottom bed sheet, and for connecting the top bed sheet to the bottom bed sheet; and wherein the lengthwise location of the head end portion of the top bed sheet is pre-set by the connection of buttons of the first row of button and button holes of the first row of button holes, the location of the head end portion of the top bed sheet compatible with a desired fold over length of the top bed sheet at the head end portion, and wherein a folded edge of the top bed sheet, when the top sheet is folded over according to the desired fold over length is located at a distance from a head end of the mattress to allow a bed pillow to be placed between the folded edge of the top bed sheet and the head end of the mattress;

wherein the first row of buttons is located a predefined distance from the foot end of the bottom bed sheet; and wherein the first row of button holes is located the same predefined distance from the foot end of the top bed sheet;

wherein a second row of buttons are located a predefined distance from the head end of the bottom bed sheet, the predefined distance equaling the predefined distance that the first row of buttons are located from the foot end of the bottom bed sheet; and wherein a second row of button holes are located a predefined distance from the head end of the top bed sheet, the predefined distance equaling the predefined distance that the first row of button holes are located from the foot end of the top bed sheet.

12. A bed sheet connecting apparatus comprising:

a fitted bottom bed sheet having corner elastic portions for gripping the bottom bed sheet to a bed or mattress or cushion, the fitted bottom bed sheet having a head end portion opposite a foot end portion, the head end portion and foot end portion arranged to overlie vertical end walls of a mattress;

a top bed sheet having a head end opposite a foot end, the top bed sheet having a rectangular perimeter;

the bottom bed sheet having a row of buttons sewn thereon on the foot end portion that overlie the vertical end wall of the mattress at a foot end thereof;

the top bed sheet having a first row of button holes near the foot end thereof and a second row of button holes spaced from the first row of button holes;

the row of buttons on the bottom bed sheet and a selectable one of the first row of button holes or the second row of button holes positioned on the top bed sheet for aligning the top bed sheet on the bottom bed sheet, and for connecting the top bed sheet to the bottom bed sheet; and wherein the lengthwise location of the head end portion of the top bed sheet is pre-set by the connection of buttons of the row of buttons to selected button holes of either the first row of button holes or the second row of button holes, the location of the head end portion of the top bed sheet compatible with a desired fold over length of the top bed sheet at the head end portion, and wherein a folded edge of the top bed sheet, when the top sheet is folded over according to the desired fold over length is located at a distance from a head end of the mattress to allow a bed pillow to be placed between the folded edge of the top bed sheet and the head end of the mattress.

13. The bed sheet connecting apparatus of claim 12, wherein a portion of the bottom bed sheet comprises a second layer of material for interspacing and strengthening the connection between the one or more buttons and the bottom bed sheet.

14. The bed sheet connecting apparatus of claim 13, wherein the second layer of material comprises twill tape.

15. The bed sheet connecting apparatus of claim 12, wherein a portion of the top bed sheet comprises a second layer of material for strengthening the one or more button holes.

16. The bed sheet connecting apparatus of claim 15, wherein the second layer of material comprises twill tape.

17. The bed sheet connecting apparatus of claim 12, wherein the button holes of the first and second rows of button holes are spaced apart to match the spacing of the buttons of the row of buttons for aligning the top bed sheet on the bottom bed sheet, and for connecting the top bed sheet to the bottom bed sheet.

18. The bed sheet connecting apparatus of claim 12, wherein the row of buttons is a first row of buttons, and the apparatus comprises a second row of buttons located near an end opposite the end having the first row of buttons.

* * * * *